US009371664B2

(12) United States Patent
Verhelst

(10) Patent No.: US 9,371,664 B2
(45) Date of Patent: Jun. 21, 2016

(54) TENT AND AN AWNING ASSEMBLY

(71) Applicant: Thule Sweden AB, Hillerstorp (SE)

(72) Inventor: Jan Verhelst, Menen (BE)

(73) Assignee: THULE SWEDEN AB, Hillerstorp (SE)

( * ) Notice: Subject to any disclaimer, the term of this patent is extended or adjusted under 35 U.S.C. 154(b) by 0 days.

(21) Appl. No.: 14/433,350

(22) PCT Filed: Oct. 8, 2013

(86) PCT No.: PCT/EP2013/070953
§ 371 (c)(1),
(2) Date: Apr. 2, 2015

(87) PCT Pub. No.: WO2014/056918
PCT Pub. Date: Apr. 17, 2014

(65) Prior Publication Data

US 2015/0259946 A1 Sep. 17, 2015

(30) Foreign Application Priority Data

Oct. 8, 2012 (EP) ..... 12187592

(51) Int. Cl.
*E04H 15/06* (2006.01)
*E04H 15/04* (2006.01)
*E04H 15/08* (2006.01)
*E04H 15/58* (2006.01)

(52) U.S. Cl.
CPC ..... *E04H 15/06* (2013.01); *E04H 15/04* (2013.01); *E04H 15/08* (2013.01); *E04H 15/58* (2013.01)

(58) Field of Classification Search
CPC ..... E04H 15/06
USPC ..... 135/88.13, 88.14, 88.16, 88.17, 88.18, 135/904
See application file for complete search history.

(56) References Cited

U.S. PATENT DOCUMENTS 1,483,741 A * 2/1924 Moffett ..... E04H 15/06 135/118
2,315,680 A * 4/1943 Ward ..... E04H 15/06 135/119
2,583,824 A * 1/1952 Dwinell ..... E04F 10/0618 160/121.1
2,788,791 A * 4/1957 Pospisil ..... E04H 15/06 135/161
3,073,326 A * 1/1963 Lefebvre ..... E04H 15/06 135/116

(Continued)

FOREIGN PATENT DOCUMENTS

DE 28 39 557 3/1980
DE 295 04 406 5/1995

(Continued)

OTHER PUBLICATIONS

International Search Report and Written Opinion of the International Searching Authority for International Appl. No. PCT/EP2013/070953, European Patent Office, Rijswijk, Netherlands, mailing date of Jan. 22, 2014, 11 pages.
European Search Report for European Application No. EP 12 18 7592.6, European Patent Office, Munich, Germany, dated Mar. 19, 2013, 7 pages.

*Primary Examiner* — Noah Chandler Hawk
(74) *Attorney, Agent, or Firm* — Sterne, Kessler, Goldstein & Fox P.L.L.C.

(57) ABSTRACT

A tent and an awning assembly, the awning assembly including an awning casing, a leading edge and an awning extending between the awning casing and the leading edge, the tent being arranged under the awning assembly. The awning casing and the leading edge each includes a channel for receiving a tent enabling a double roof configuration.

13 Claims, 5 Drawing Sheets

(56) References Cited

U.S. PATENT DOCUMENTS 3,186,419 A * 6/1965 McCarroll ..... E04H 15/06 135/140
3,228,406 A * 1/1966 Jamba ..... E04H 15/06 135/150
3,469,589 A * 9/1969 Mitchell ..... B60P 3/38 135/87
3,599,651 A * 8/1971 Perry ..... E04H 15/06 135/139
4,114,633 A * 9/1978 Herbez ..... E04H 15/06 135/117
4,175,576 A * 11/1979 Iby ..... E04H 15/06 135/119
4,754,774 A * 7/1988 Leader ..... E04H 15/06 135/120.2
5,170,811 A * 12/1992 Kirk ..... B60P 3/343 135/88.11
5,190,066 A * 3/1993 Joergensen ..... B60P 3/343 135/115
5,718,253 A * 2/1998 McNamee ..... E04H 15/08 135/88.1
5,738,130 A * 4/1998 Thomas ..... E04H 15/06 135/88.13

FOREIGN PATENT DOCUMENTS

DE 199 43 944 3/2000
DE 200 16 691 5/2001
DE 20 2010 008352 11/2010
DE 20 2010 012 840 12/2010
EP 0 657 323 6/1995
EP 2 025 555 2/2009
FR 1600528 A * 7/1970 ..... B60P 3/343
IT DE 202011052388 U1 * 2/2012 ..... E04F 10/06

* cited by examiner

TENT AND AN AWNING ASSEMBLY

FIELD

An awning assembly comprising an extendable and retractable awning and a tent adapted to be mounted to the awning assembly. The awning assembly comprises an awning casing in which the awning can be wound up, and a displaceable leading edge. The awning assembly enables a double roof configuration by means of the awning and the tent. The tent is adapted to be mounted to the awning in a favorable manner.

BACKGROUND

Recreational vehicles (RV's) can advantageously be equipped with an awning. Awnings provide shelter, partly from wind but mainly from rain and sun light. It also provides for an extended comfort zone, or extended living area, although with some limitations. In windy or cold weather conditions, it is sometimes not sufficient to rely on an awning only to provide a comfortable and extended living area outside of the RV or caravan, some occasions may require a tent.

Tents are per se frequently used to provide comfortable extended living areas outside of RV's and caravans. Not many solutions however combine the advantages and existing structures of awnings with tents. An attempt to take advantage of an awning assembly is disclosed in the publication of DE19943944A1, Brutsaert Accessories N.V., in which an awning assembly is disclosed. The awning assembly comprises an awning, a leading rail and two support arms for extracting and retracting the awning. A supplementary tent can be mounted to the awning via two bars extending between the caravan and the leading rail. The solution is not very elegant as it requires additional bars and does not permit the use of the whole length of the awning assembly, hence the tent is relatively limited in size.

The European patent EP 0,657,323 B1 discloses an awning assembly comprising an awning arranged between a roller tube and a leading rail. A pair of support arms enables the leading rail and the awning to be extracted and retracted. The leading rail comprises a lower C channel disposed on the edge of the leading rail for hanging plants, lights, and screen rooms. The solution is however silent of how the advantages of an awning can be combined with the advantages of a tent.

SUMMARY

It is an object of the present invention to provide for an improved tent adapted to be mounted to an awning assembly which at least partly reduces the drawbacks of the above mentioned prior art, or at least provides for a useful alternative. The objects are at least partly met by a tent for an awning assembly. The awning assembly comprises an awning, an awning casing and a leading edge. The tent is adapted to be mounted under the awning. The tent comprises a first tent portion and a second tent portion. The first tent portion comprises at least one elongated element adapted to be inserted into a channel of the awning casing, or in a channel of an awning carrying object, and the second tent portion comprises at least one elongated element adapted to be inserted into a first channel of the leading edge of the awning assembly.

The tent can easily be positioned in any desired position along the length of the awning assembly. It also enables a quick installation of the tent. As fewer individual components are required, it can generally be considered to be a relative light weight and compact package to transport. The solution does not require any specific arrangements on the awning carrying object itself, other than the mentioned channels.

Further, as a full tent can be mounted to an awning assembly, a roof portion can be positioned beneath the awning itself, thus providing a double roof configuration, which can be adapted to be a double ventilated roof. It enables a perfect closure between the roof and side walls. It also enables a tent of standard size to be used with substantially any awning assembly, i.e. there is no need to have a tent with substantially the same dimensions as the awning or awning assembly.

A roof portion can be arranged between the first and the second tent portions, or the tent be formed by side walls only, thus using the awning of the awning assembly as roof.

According to an aspect, the elongated element has a length, and the first and/or second tent portion has a length. The length of the elongated element is equal or substantially equal to the length of the first and/or second tent portion, or optionally to the length of the tent. Optionally, the elongated element can be significantly shorter than the length of the first and/or the second tent portion, in this case, it is advantageous if at least one of the first or the second tent portions has a plurality of elongated elements for insertion into the channel of the leading edge of the awning assembly.

According to an aspect, the elongated element is a flexible, yet self-sustaining elongated element e.g. formed by a thermoplastic material.

According to an aspect, the elongated element is arranged in a pocket formed by a part of the first and/or the second tent portions. The pocket can be a tubular pocket having an elongation corresponding to the tent portion or be partitioned into individual tubular pockets.

According to an aspect, the at least one of the tent portions comprises extension means, such as extension straps, e.g. at least one adjustable extension strap, or similar. This permits a tent of one size to fit awning assemblies of different sizes. The extension straps can advantageously be adjustable extension straps, or be extension straps of a predetermined size. Optionally, the extension means, e.g. the extension straps, straps are arranged between the tent portion, e.g. between the first tent portion, and the elongated element. The elongated element can thus be distal to the tent portion.

According to an aspect, the invention relates to a tent and an awning assembly.

According to an aspect, the first tent portion is connected directly to the channel of the awning casing, and the second tent portion is connected directly to the first channel of the leading edge. This enables a large spacious tent relative to the size of the awning assembly.

The awning assembly is adapted for an awning carrying object, such as a vehicle, caravan and/or building. The awning assembly comprises an awning casing comprising an awning. The awning comprises a proximal end and a distal end, the proximal end of the awning is connected to the awning casing so that the awning can be retracted and extracted from the awning casing, and the distal end of the awning is connected to a leading edge. The awning assembly is adapted to be connected to a tent having a first tent portion, a second tent portion and a roof portion extending between the first and the second tent portion.

The leading edge comprises a first channel for connection with the first tent portion, and the awning casing comprises a second channel for connection with the second tent portion. The awning assembly permits a complete tent, if desired, to be mounted between the leading edge and the awning casing, without mounting of additional profiles. It thus enables a quick installation of a tent. As fewer individual components are required, it can generally be considered to be a relative light weight and compact package to transport. The solution does not require any specific arrangements on the awning carrying object itself.

Further, as a full tent can be mounted to the awning, a roof portion can be positioned beneath the awning itself, thus providing a double ventilated roof. It enables a perfect closure between the roof and side walls. It also enables a standard size of the tent, i.e. there is no need to have a tent with substantially the same dimensions as the awning.

According to an aspect, the leading edge has a first longitudinal length, and the first channel of the leading edge has a longitudinal length substantially equal to the first longitudinal length of the leading edge. Although an equal length is desired, the leading edge can be provided with end caps e.g. to temporarily or permanently seal the channels. This enables the option to slide the tent to any desired position along the leading edge, e.g. if the position of e.g. the door or the window require compensation or consideration. A suitable material and manufacturing method to form the leading edge is forming the leading edge by extruding aluminium.

According to an aspect, the leading edge is adapted to be mounted to the awning carrying object such as a vehicle or caravan or the like, and the awning casing is displaceably arranged to the awning carrying object. A preferred embodiment is when the awning casing is mounted to the awning carrying object and the leading edge is displaceably arranged to the awning carrying object.

According to an aspect, the awning assembly comprises at least one support arm, e.g. two support arms, extending between the awning casing and the leading edge, the at least one support arm is adapted to displace the leading edge between an extracted position and a retracted position. The displacement can be operated via an electrical motor, or manually via a lever. Each support arm can be formed by two or more bars connected by a pivot joint.

According to an aspect, the at least one support arm is connected to the leading edge at a position between, or substantially between, the awning and the first channel. This removes any interference the support arms may have on the tent and the draping or stretching of the side walls of the tent.

According to an aspect, the leading edge comprises a second channel, the distal end of the awning is connected to the second channel of the leading edge. The second channel can be substantially parallel to the first channel of the leading edge.

According to an aspect, the awning assembly comprises an awning casing, a leading edge and an awning extending between the awning casing and the leading edge. The awning casing and the leading edge each comprise a channel for receiving a tent portion enabling a double roof configuration.

The channel of the awning casing and the first channel of the leading edge comprises an opening from which the tent portions extends, as described herein, such opening can be formed by having channels with a C-shaped cross section, or a substantially C-shaped cross section, for example. The channel of the awning casing and the first channel of the leading edge are preferably facing towards each other in the sense that the opening of each of the channels are substantially facing each other, or at least facing in a direction towards the tent. The openings are preferably facing towards each other when the awning is extracted.

BRIEF DESCRIPTION OF THE DRAWINGS

Non-limiting embodiments of the invention will be described with reference to the accompanying Figures in which.

DETAILED DESCRIPTION

Figure 1:
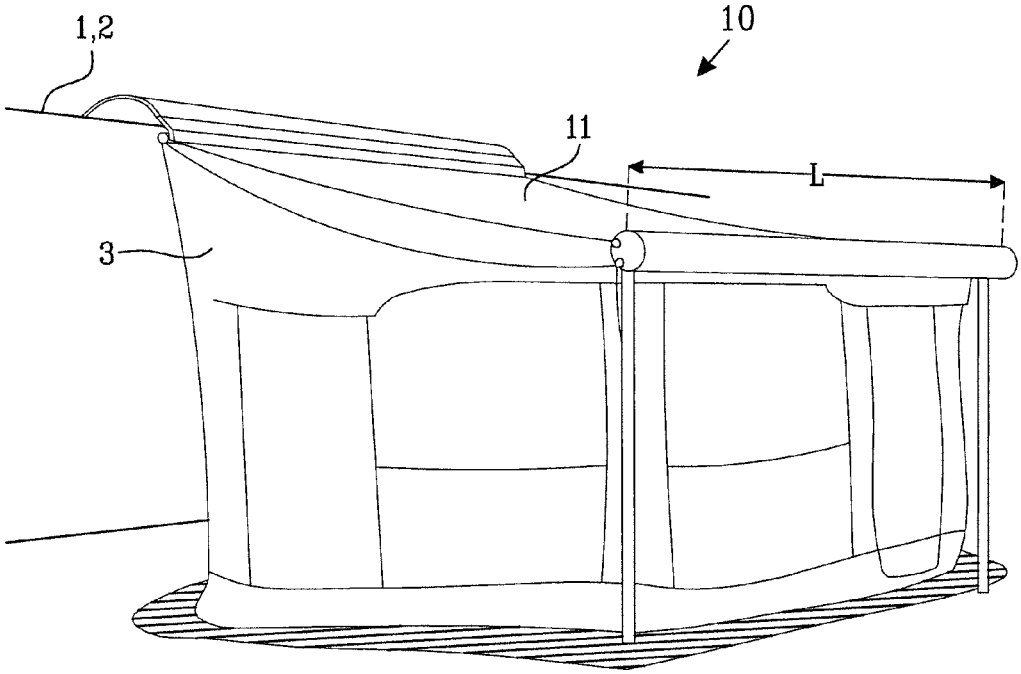
FIG. 1 shows an awning assembling with a tent, as seen in perspective.

FIG. 1 shows parts of an awning carrying object, in this case a caravan 1 with a roof 2. An awning assembly 10 comprising an awning 11 is attached in the proximity of the roof 2 of the caravan. The awning assembly 10 is arranged along the length of the caravan 1 in a substantially horizontal position. A tent 3 is attached to the awning assembly 10 providing an extended comfort zone, or extended living area. Examples of awning carrying objects are buildings such as villas, bungalows, vehicles, preferably recreational vehicles (RV's), caravans or the like. The length L of the awning assembly is indicated in FIG. 1.

Figure 2:
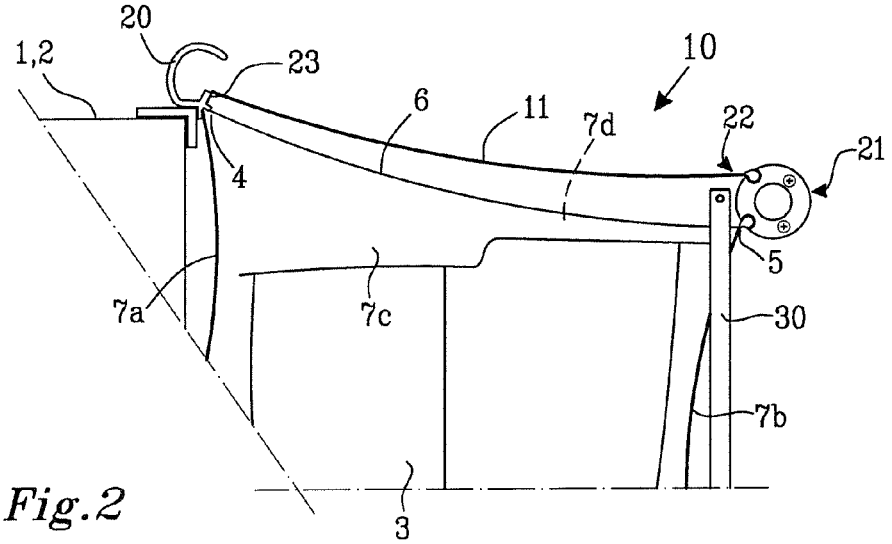
FIG. 2 shows the awning assembly of FIG. 1 with a view towards the side.

FIG. 2 shows the awning assembly 10 and the caravan 1 of FIG. 1 from the side. The awning assembly 10 comprises an awning casing 20 attached to the caravan 1 from which the awning 11 can be extracted and retracted. The awning 11 has a proximal end 23 and a distal end 22, the proximal end 23 of the awning 11 is attached to the awning casing 20 and the distal end 22 is attached to a leading edge 21. In the shown embodiment, the leading edge 21 can be displaced with respect to the caravan 1 to extract the awning 11 and thus form a leading edge during such displacement. The leading edge 21 can also be referred to as a leading rail. The awning 11 can be wound up about an axle (not shown) in the awning casing 20 or be attached to the awning casing 20 in any other suitable manner. The awning casing 20 can itself be attached to the caravan 1 using existing means of the caravan 1 such as existing channels for attaching accessories or be attached by other known means such as screws, rivets or bolts. A support arrangement 30 keeps the leading edge 21 in an elevated and appropriate position, it also enables the leading edge 21 to be extracted and retracted.

The tent 3 comprises a first tent portion 4, a second tent portion 5 and a roof portion 6 extending between the first and the second tent portion 4, 5, and tent walls 7*a*, 7*b*, 7*c*, 7*d* which delimit the extended living area provided by the tent 3. The first and the second tent portions 4, 5 the angled transition portion between a tent wall and the roof portion 6 of the tent 3. Optionally, the tent portion 5 can comprise extension means to connect the tent 3 to the awning casing 20, and/or preferably to the leading edge 21, permitting the position of the tent 3 to be adjusted with respect to the awning casing 20 and the caravan 1, and for the roof portion 6 to be tightened. Having extension means permits a tent with a specified size to fit different awning assemblies of different sizes, especially awnings of different sizes.

Figure 3:
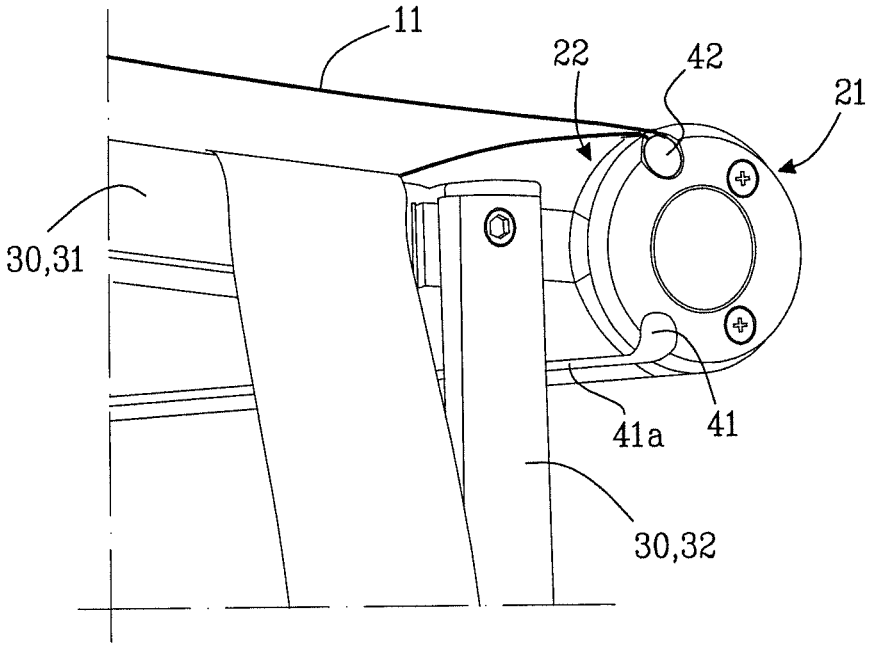
FIG. 3 shows the leading edge of the awning assembly of FIG. 1 in greater detail.

FIG. 3 shows the leading edge 21 and parts of the awning 11 in greater detail. FIG. 3 further shows parts of the support arrangement 30 comprising two support arms 31 and two support legs 32, however only one of the support arms 31 and one support leg 32 are partly shown in FIG. 3. In some embodiments, only one support arm is present. It is also possible to have only one support leg for example. The number of support arms and/or support legs is selected dependent of the weight and the required extension of the awning and sometimes the awning assembly.

The leading edge 21 comprises, in the shown embodiment, a first and a second channel 41, 42 extending along the length of the leading edge 21. The first channel 41 has an opening 41*a* through which the tent portion can extend after being inserted into the channel. As is noticed, the first and the second channels 41, 42 have a C-shaped cross section forming an opening through which the tent portion can extend after being inserted into the channel. Other cross sections are plausible. An important feature of the cross section is that it has an opening, the tent portion can be inserted and retained, and optionally be permitted to slip along the length of the channel. The first channel 41 of the leading edge 21 is specifically adapted to receive the tent portion 5 (not shown in FIG. 3), or extension means attached to the tent portion 5, such as adjustable extension straps. The first channel 41 extends along the full length of the leading edge 21 and permits adjustment of the position of the tent portion 5 along the length of the leading edge 21 if desirable.

The second channel 42 of the leading edge 21 is used to attach the distal end 22 of the awning 11. It should be noted that the distal end 22 of the awning 11 does not necessarily need to be the absolute distal end of the awning 11 but is intended to incorporate embodiments in which the awning 11 might have some minor length of the awning 11 hanging freely from the leading edge 21, or a similar embodiments. The awning 11 can also be attached to the leading edge 21 by other available means.

The first channel 41 and the second channel 42 of the leading edge 21 are parallel with respect to each other. The support arms 31 are positioned between the first and the second channels 41, 42 of the leading edge 21. This permits the tent 3 to be positioned in a favorable position.

In an embodiment, the leading edge 21 is attached to the caravan 1 and the awning casing 20 is displaceable with respect to the leading edge 21, so that when the awning casing 20 is displaced in a direction away from the caravan 1, the awning 11 is extracted, and vise verse. Both the awning casing 20 and the leading edge 21 can thus be used to attach a tent portion and to provide for an extended living area. An advantage in some embodiments is that the roof portion 6 of the tent 3 provides additional heat insulation by providing a second roof layer with respect to the awning 11.

Figure 4:
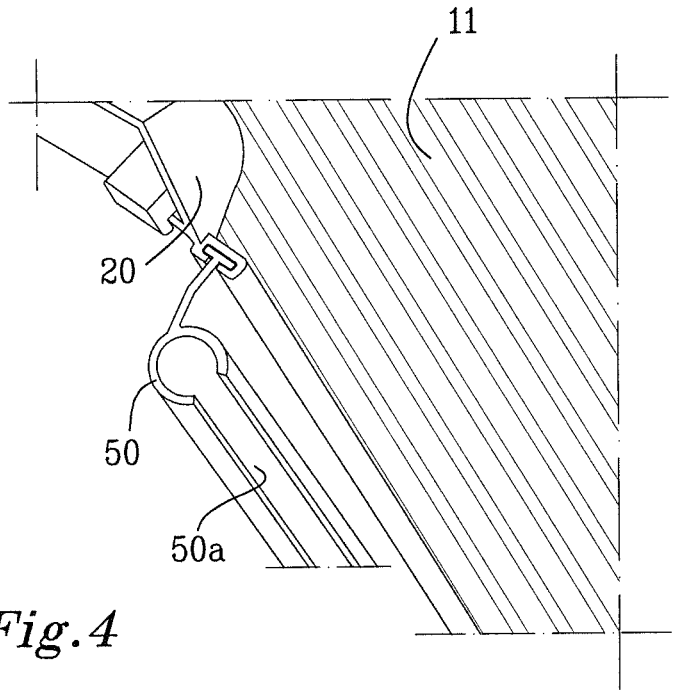
FIG. 4 shows the channel of the awning casing.

FIG. 4 shows parts of the awning casing 20 and the awning 11. The awning casing 20 comprises a channel 50 for receiving the first tent portion 4 of the tent 3. As is noticed, the channel 50 of the awning casing 20 has a similar cross section as the cross section of the first channel 41 of the leading edge 21 (shown in FIG. 3), in this case a C-shaped cross section. The channel thus has an opening 50*a* through which the tent portion can extend after being inserted into the channel. Other cross sections of the channel are possible, such as L- or T-shaped cross sections or the like. As can be seen in FIG. 4, the channel 50 of the awning casing 20 is connected to the awning casing 20 as a separate element, but could be integrally formed with a main body of the awning casing 20. The opening 50*a* of the channel 50 of the awning casing 20 is facing towards the tent 3, and in a similar manner, the opening 41*a* of the first channel 41 of the leading edge 21 is facing towards the tent 3. The openings 41*a*, 50*a* of the channels 41, 50 are thus facing each other, at least when the awning 11 is extracted as shown in FIGS. 1 and 2, to provide for a favourable position of the tent 3.

Figure 5:
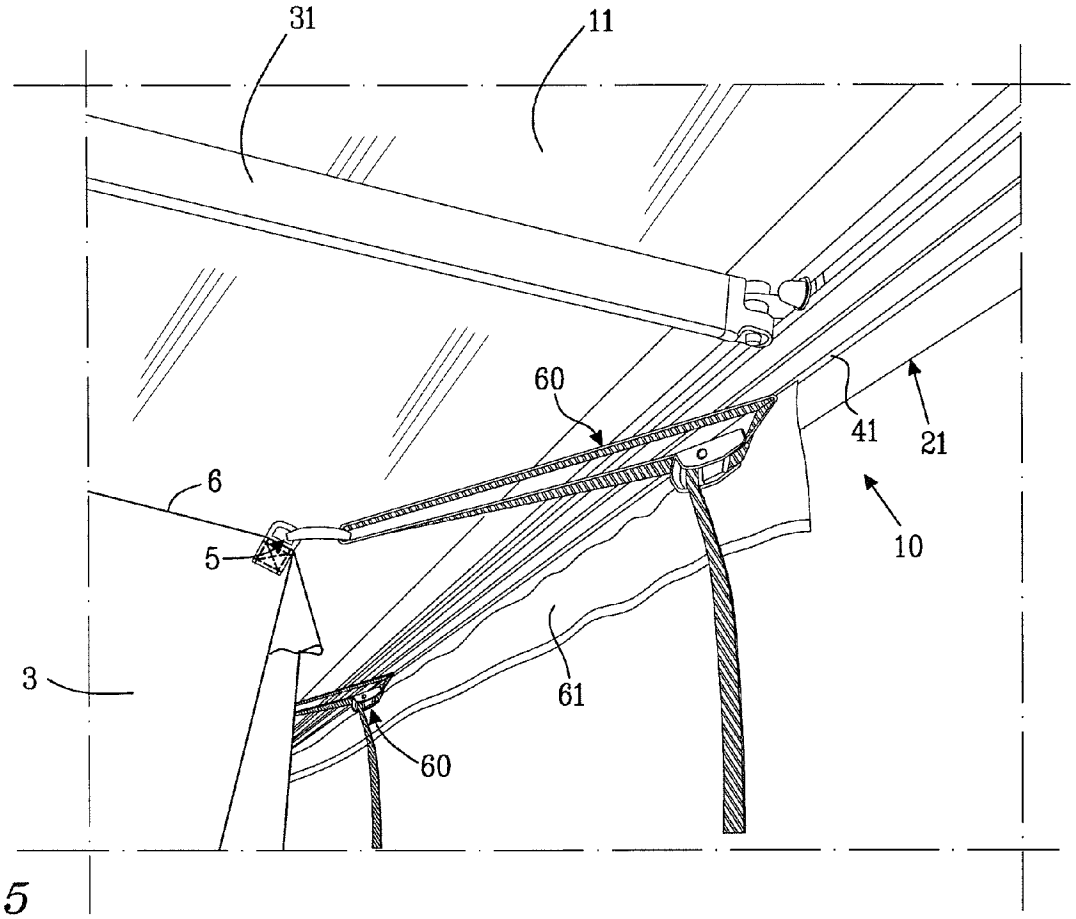
FIG. 5 shows the underside of the awning, the leading edge and one of the tent portions comprising straps.

FIG. 5 shows the tent 3, the underside of the awning 11, the leading edge 21, the first channel 41 of the leading edge 21 and one support arm 31. FIG. 5 shows an embodiment in which the second portion 5 of the tent 3 is attached to the leading edge 21 of the awning assembly 10 via an adjustable extension strap 60. In the shown embodiment, the second tent portion 5 of the tent 3 comprises extension means, in this case the adjustable strap 60, which can be mounted in the channel 41 of the leading edge 21 via a strap mounting member 61. The strap mounting member 61 can have a plurality of adjustable extension straps 60 permitting the tent 3, and especially the roof portion 6 of the tent 3 to be tightened between the awning casing 20 and the leading edge 21. In the shown embodiment, the two adjustable straps 60 are arranged to retain the tent 3, and especially the second tent portion 5, to the leading edge 21.

Figure 6:
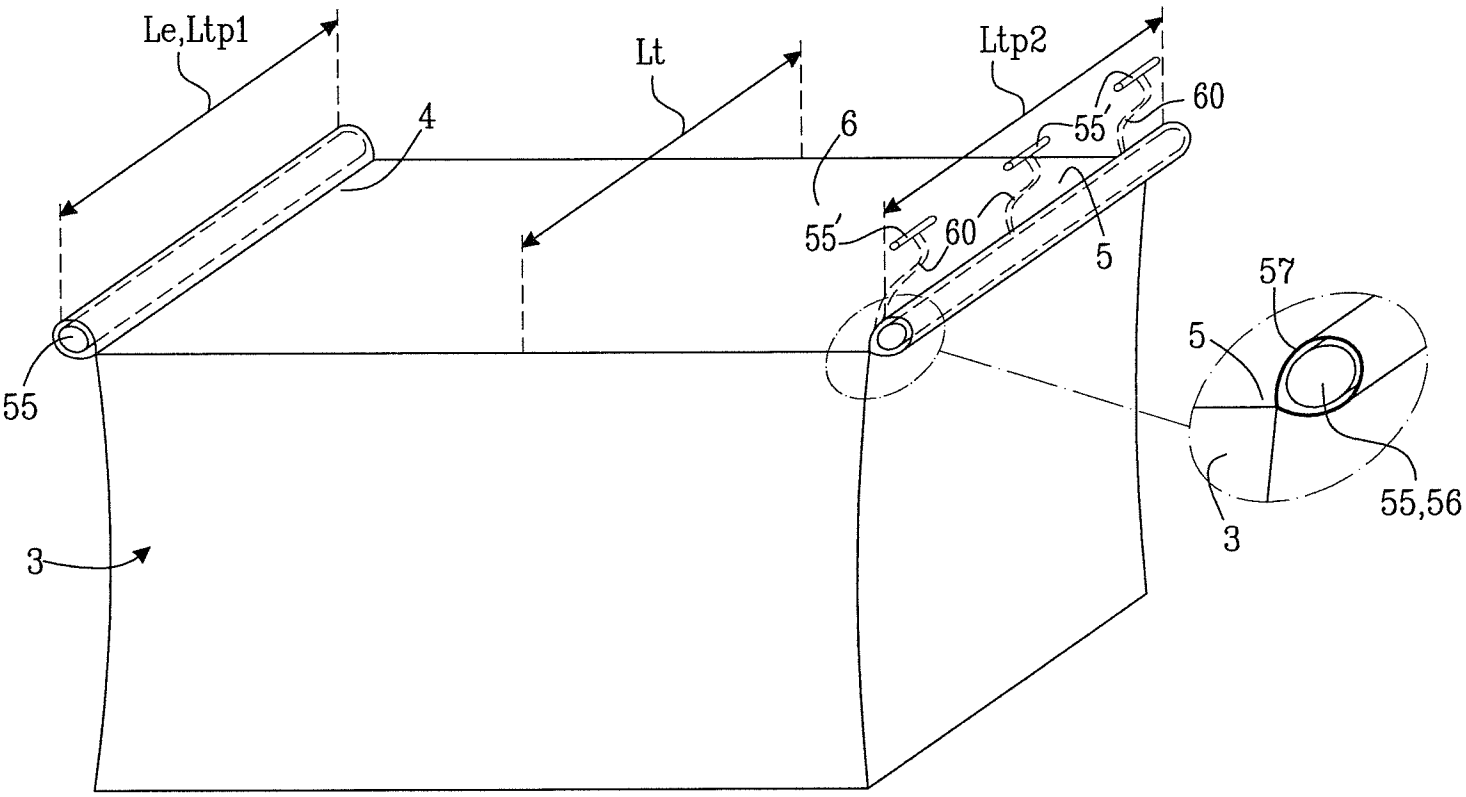
FIG. 6 shows a tent adapted to be mounted to an awning assembly.

FIG. 6 shows a schematic illustration of the tent 3 in greater detail and with the first and the second tent portions 4, 5 heavily exaggerated for the purpose of clarity. Each tent portion 4, 5 comprise an elongated element 55 and has a length Ltp1, Ltp2. The elongated element 55 is in this case a rod 56 of thermoplastic material. The elongated element has a length Le which substantially corresponds to the length Ltp1, Ltp2 of the first and the second tent portions 4, 5, of the tent 3. A part of tent portions 4, 5 forms a pocket 57, in this case a tubular pocket advantageously with a length corresponding to the length Ltp1, Ltp2 of the tent portions 4, 5 or of the tent 3, in which the elongated element 55 can be inserted into. The elongated element 55 can be flexible, but is preferably self-sustaining, e.g. formed by a thermoplastic material such as polypropylene. It is possible however that the elongated element is formed by a wire, or string, such as a piece of rope sewn into the first and/or the second tent portions 4, 5. In cases when wires or strings are used, the elongated element is flexible but not really self-sustaining, as a wire or string collapse by its own weight when laid on e.g. on a flat surface.

The main function of the elongated elements 55 are to retain the first and the second tent portions 4, 5 of the tent 3 to the awning casing 20 and the leading edge 21 of the awning assembly 10. A completely rigid and stiff elongated element e.g. formed by a stiff stainless steel rod is possible but less preferably due to the weight and cumbersome space required to store such elongated element.

When assembling the tent 3 with the awning assembly 10, the first and the second tent portions 4, 5 with the pockets 57 and the elongated elements 55 are inserted in each respective channel. The pocket 57 with the elongated elements 55 of the first tent portion 4 is inserted in the channel 50 of the awning casing 20, while the pocket 57 with the elongated elements 55 of the second tent portion 5 is inserted in the first channel 5 of the leading edge 21. As an alternative, the first portion 4 of the tent 3 can be mounted directly to a corresponding channel on the awning carrying object (not shown). The tent 3 can be mounted before the awning 11 is extracted or after the awning 11 is extracted.

If the tent 3 is mounted to the awning assembly 10 when the awning 11 is in a retracted position, the first and the second tent portions 4, 5 of the tent 3 will be displaced further away from each other as the awning 11 is extracted. During this procedure, the tent 3 will practically be raised. If the tent 3 is mounted to the awning assembly 10 when the awning assembly 10, and the awning 11, is already extracted, it might be appropriate to retract the awning 11 a shorter distance to enable an easy mounting of the tent 3. The awning assembly 10 can then be used to stretch, or tighten, the tent 3, and especially the roof portion 6 of the tent 3 by extracting the awning 11 to an extracted position. If at least one of the first and/or the second tent portions 4, 5, comprises extension means, such as one or more adjustable extension straps 60 (as shown in FIG. 5), the tent 3 can easily be mounted when the awning 11 is in the extracted position, and thereafter be stretched, or tightened, by the adjustable extension strap.

FIG. 6 also shows an alternative embodiment in which adjustable straps 60 are arranged between the second tent portion 5 and elongated elements 55', in FIG. 6 the adjustable straps 60 are indicated with dashed lines. The embodiment illustrated three elongated elements 55' attached to the second tent portion 5 via three adjustable straps 60. The number of adjustable straps and elongated elements 55' can advantageously between from 2-10. Instead of adjustable straps 60, the elongated elements 55' and the extension means, in this case formed by the adjustable straps 60, can be formed in one unitary piece of material, e.g. by form molding the elongated element 55' with an extension rod.

It is advantageous if the tent 3, when mounted to the awning casing and the leading edge of the awning assembly, can be positioned in any desired position along the length L of the awning (shown in FIG. 1). The position of the tent 3 could thus be adjusted to different desires and needs. The channel of the awning casing 20 has a first length and the first channel of the leading edge has a second length. The first length of the channel of the awning casing is substantially equal, or equal, to the second length of the first channel of the leading edge. Furthermore, the first length of the channel of the awning casing and the second length of the first channel of the leading edge are substantially equal, or equal, to the length L of the awning assembly 10.

Figure 7:
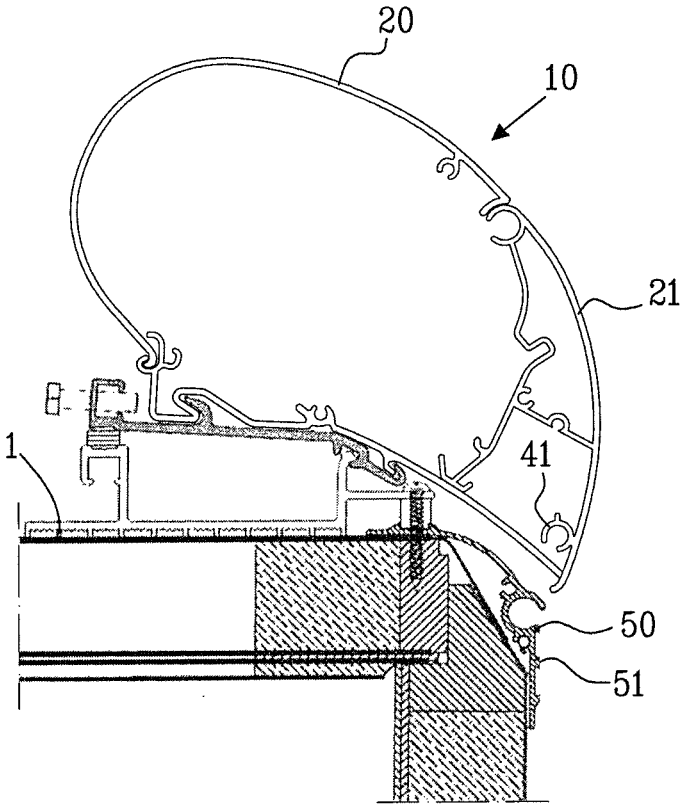
FIG. 7 shows a cross section of an embodiment of an awning assembly.

FIG. 7 shows an embodiment of an awning assembly 10 attached to a caravan 1. The awning assembly 10 is illustrated without the awning for the purpose of clarity. The awning assembly 10 comprises an awning casing 20, and a leading edge 21. The awning casing 20 comprises a channel 50, attached to the caravan 1 via a rail 51. The leading edge 21 comprises a first channel 41, in this case formed by the leading edge 21, i.e. it has been formed in one unitary piece of material with the leading edge 21.

The invention claimed is:

1. A tent and an awning assembly, said awning assembly comprising:

an awning casing; and an awning, said awning comprising a distal end and a proximal end, said proximal end of said awning being connected to said awning casing, said distal end of said awning being connected to a leading edge so that said awning can be retracted and extracted from said awning casing, wherein said tent is arranged under said awning, said tent comprising:

a first tent portion;

a second tent portion; and a roof portion between said first and said second tent portions, wherein said first tent portion comprises at least one elongated element adapted to be inserted into a channel of said awning casing, or in a channel of an awning carrying object, and wherein said second tent portion comprises at least one elongated element adapted to be inserted into a first channel of said leading edge of said awning assembly.

2. The tent and awning assembly according to claim 1, wherein said elongated element has a length (Le), and wherein said first or second tent portion has a length (Lt), said length (Le) of said elongated element being substantially equal to said length (Lt) of said first or second tent portion.

3. The tent and awning assembly according to claim 1, wherein said elongated element is a flexible, self-sustaining, elongated element formed by a thermoplastic material.

4. The tent and awning assembly according to claim 1, wherein said elongated element is arranged in a pocket formed by a part of the first or the second tent portions.

5. The tent and awning assembly according to claim 1, wherein at least one of said tent portions comprises an extension means comprising at least one adjustable extension strap.

6. The tent and awning assembly according to claim 5, wherein said extension means is arranged so that said elongated element is distal of said first or second tent portion.

7. The tent and awning assembly according to claim 1, wherein said awning casing comprises a channel for connecting said first tent portion, and wherein said leading edge comprises a first channel for connecting said second tent portion.

8. The tent and awning assembly according to claim 7, wherein said leading edge has a first longitudinal length, and wherein said first channel of said leading edge has a longitudinal length substantially equal to said first longitudinal length of said leading edge.

9. The tent and awning assembly according to claim 7, wherein said tent can be slid along the length of said awning assembly, permitting the position of said tent to be adjusted.

10. The tent and awning assembly according to claim 7, wherein said leading edge comprises a second channel, said second channel being substantially parallel to said first channel of said leading edge.

11. The tent and awning assembly according to claim 7, wherein said channel of said awning casing has a first length, and wherein said first channel of said leading edge has a second length, wherein said first length of said channel of said awning casing is substantially equal to said second length of said channel of said leading edge.

12. The tent and awning assembly according to claim 1, wherein said channel of said awning casing and said first channel of said leading edge each comprises an opening, wherein said openings are substantially facing each other, at least after said awning has been extracted from said awning casing.

13. The tent and awning assembly according to claim 1, wherein said first tent portion is connected directly to said channel of said awning casing, and wherein said second tent portion is connected directly to said first channel of said leading edge.

* * * * *